US006739916B2

(12) United States Patent
Geil et al.

(10) Patent No.: US 6,739,916 B2
(45) Date of Patent: May 25, 2004

(54) MULTIPOLE ELECTRICAL CONNECTOR

(75) Inventors: Andreas Geil, Stuttgart (DE); Werner Birkle, Markgroeningen (DE); Volker Breunig, Ditzingen (DE); Piotr Deptula, Illingen (DE)

(73) Assignee: Robert Bosch GmbH, Stuttgart (DE)

( * ) Notice: Subject to any disclaimer, the term of this patent is extended or adjusted under 35 U.S.C. 154(b) by 0 days.

(21) Appl. No.: 09/801,527

(22) Filed: Mar. 8, 2001

(65) Prior Publication Data

US 2001/0031583 A1 Oct. 18, 2001

(30) Foreign Application Priority Data

Mar. 8, 2000 (DE) ..... 200 03 951 U

(51) Int. Cl.[7] ..... H01R 13/648
(52) U.S. Cl. ..... 439/682; 439/691
(58) Field of Search ..... 439/682, 685, 439/465, 686, 891, 79, 101, 105, 106, 324, 298

(56) References Cited

U.S. PATENT DOCUMENTS 3,609,630 A * 9/1971 Francis ..... 339/14
3,732,531 A * 5/1973 Bouley ..... 339/217
3,748,633 A * 7/1973 Lundergan ..... 439/682
5,066,236 A * 11/1991 Broeksteeg ..... 439/79
5,823,798 A * 10/1998 Zintler et al. ..... 439/76.2
6,041,498 A * 3/2000 Hillbish et al. ..... 29/883
6,196,853 B1 * 3/2001 Harting et al. ..... 439/79

FOREIGN PATENT DOCUMENTS

DE 295 08 805 11/1996

* cited by examiner

*Primary Examiner*—Alex Gilman
(74) *Attorney, Agent, or Firm*—Kenyon & Kenyon

(57) ABSTRACT

A multi-pole electrical connector is to be designed such that it is usable under cramped installation conditions and can be cost-effectively produced. The connector has a contact set having a plurality of contact elements, each of which has a connecting section and a contact section. Both the connecting sections and the contact sections are formed from a single-layer stamped grid and are arranged in one plane. This connector is provided for use in the automobile industry, particularly in fuse boxes and electrical-system control units of motor vehicles.

19 Claims, 1 Drawing Sheet

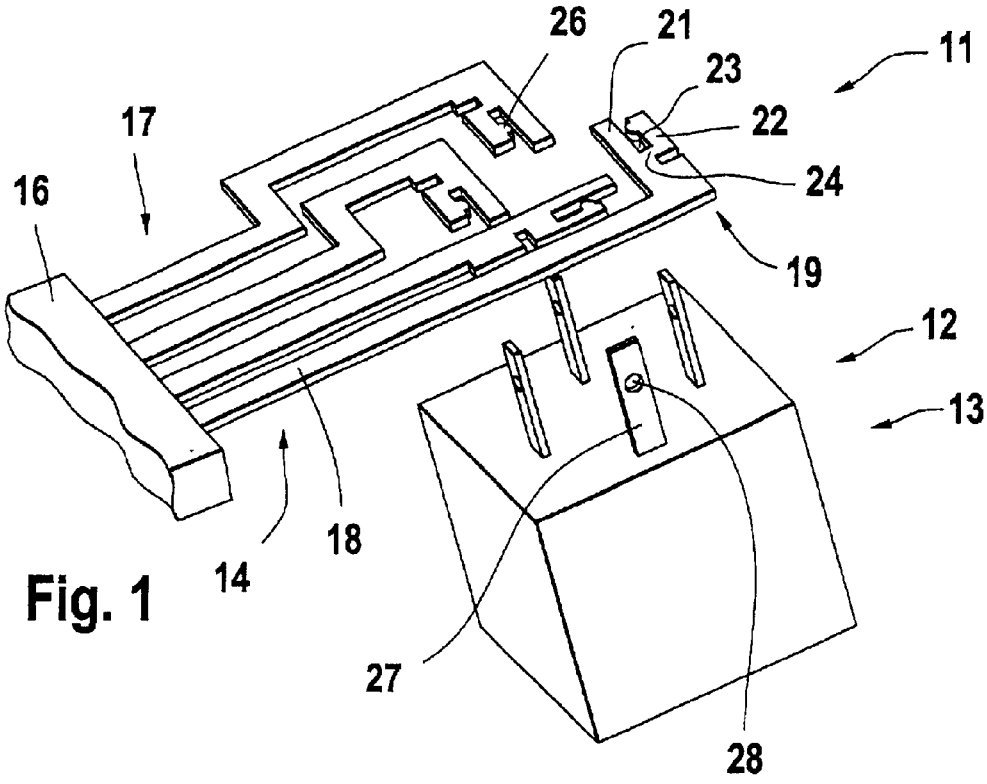
Fig. 1
Fig. 2
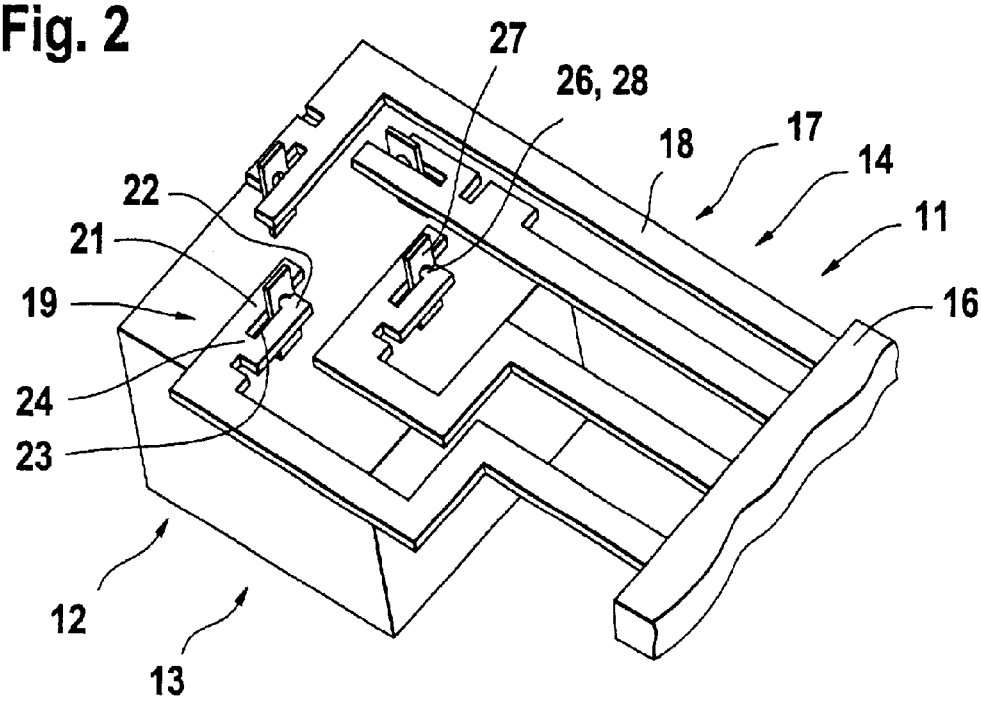

MULTIPOLE ELECTRICAL CONNECTOR

FIELD OF THE INVENTION

The present invention is based on a multipole electrical connector.

BACKGROUND INFORMATION

A connector is described in German Published Patent Application No. 295 08 805.

The connector includes a contact set having a plurality of contact elements. Each of the contact elements has a contact section and a connecting section.

The connecting sections of the contact elements are flat, web-type bars which are produced from a metal sheet of uniform thickness by a stamping process, forming a stamped grid. At first the connecting sections are temporarily interconnected by transverse webs, which are later replaced by a plastic extrusion coat and then removed, so that a one-piece unit, the stamped grid, is formed.

The end of each connecting section is folded over, forming a joining region for a contact section. Placed in each joining region is a cutout into which the assigned contact section is inserted in a direction perpendicular to the connecting section and integrally joined.

This manner of producing the contact elements is undesirably costly from a standpoint of production engineering, and the contact elements take up a large space, so that use under restricted space conditions is rendered difficult or prevented.

SUMMARY OF THE INVENTION

On the other hand, the multipole electrical connector of the present invention has the advantage that the previously mentioned shortcomings are avoided to a satisfactory degree.

To that end, both the contact sections and the connection sections of the contact elements are produced in one operation from a metal strip, forming a single-layer stamped grid, thus simplifying the production. In addition, the contact sections are arranged in one plane with the connecting sections, resulting in flat contact elements which are also usable under restricted space conditions.

BRIEF DESCRIPTION OF THE DRAWINGS

FIG. 1 shows a connector set apart from mating connector.

FIG. 2 shows the connector and the mating connector put together.

DETAILED DESCRIPTION

A multipole electrical connector 11, shown in FIGS. 1 and 2, is part of an electric pin-and-socket coupler and is provided for releasable coupling with a mating connector 12 as part of an electrical aggregate 13 such as a relay or a fuse.

A contact set 14 of connector 11 is partially extrusion-coated with plastic, the plastic extrusion coating at the same time forming a housing 16 of connector 11, the housing only being indicated.

Alternatively, contact set 14 can be clamped between two halves of housing 16 that are to be clipped.

Contact set 14 includes a plurality of contact elements 17. Each of these contact elements 17 has a connecting section 18 and a contact section 19.

Connecting sections 18 and contact sections 19 are produced from a metal strip by a stamping process, forming a single-layer stamped grid. Crossbars, not shown in the Figures, are at first placed temporarily between sections 18, 19 as individual stamped-grid webs, so that the single-layer stamped grid can be easily manipulated as one part for further producing connector 11. During the further course of production, i.e. either prior to or during the extrusion-coating of the stamped grid in the mold, or else prior to inserting the stamped grid by machine into the prefabricated halves of housing 16, the crossbars are removed and the stamped grid is broken up into individual contact elements 17 which are electrically isolated from one another and are now retained by the plastic extrusion coating.

In each case, connecting sections 18 and contact sections 19 are in one piece by themselves, and all are arranged in one plane. Strip-shaped connecting sections 18 emanate from housing 16, some having a straight, and some an angled profile. For the most part, connecting sections 18 change over into respective contact sections 19 at a right bending angle. Each of contact sections 19 is fork-shaped at its free end, having a first limb 21, opposite which, over at least a partial length, a second limb 22 is disposed at least approximately in parallel, and separated by a slit 23. Second limb 22 emanates perpendicularly from a tie bar 24 which branches off perpendicularly from first limb 21. Due to this indirect arrangement of second limb 22 on first limb 21, second limb 22 is able to be deflected outward with respect to first limb 21, thus widening slit 23.

The second limb has a detent element 26 in the form of a dome-shaped bulge which projects into slit 23. When contact section 19 is contacted with a strip-shaped counter-contact section 27 of mating connector 12, during which second limb 22 is resiliently displaced with respect to first limb 21, thus widening slit 23, then detent element 26, under spring-back resilience of second limb 22, engages in a counter-detent element 28 in the form of an opening in counter-contact section 27, so that the tensional contacting of contact section 19 against counter-contact section 27 is positioned and retained with positive-locking via this detent connection.

Alternatively, contact section 19 can also deviate from the fork shape and, for example, have a frame-shaped design, counter-contact section 27 then being contacted within the frame and a reinforced elastic-recovery capability of contact section 19 thereby being achieved compared to the fork-shape design.

Thus, a contacting is produced which, because of the design of contact elements 17, requires only little space, the forming of contact elements 17 using a single-layer stamped grid being favorable from the standpoint of production engineering.

What is claimed is:

1. A multipole electrical connector for providing a releasable coupling with a multipole mating connector, comprising:

a housing; and a contact set supported in the housing, the contact set including a plurality of contact elements, each of the contact elements configured to receive a different counter-contact section of the multipole mating connector, each of the contact elements including a contact section and a connecting section; wherein the contact elements are arranged in a single plane and form a single-layer stamped grid, wherein the counter-contact section forms a non-zero angle with the single-layer stamped grid.

2. The connector according to claim 1, wherein at least each connecting section of each contact element is one of: i) partially extrusion-coated with plastic to form the housing, and ii) clamped between two halves of the housing.

3. The connector according to claim 1, wherein each contact section is forked shaped and includes a first limb and a second limb, the second limb being separated by a slit from the first limb and being disposed at least over a partial length of the first limb.

4. The connector according to claim 3, wherein the first limb and the second limb are disposed parallel to each other.

5. The connector according to claim 3, further comprising:

at least one tie bar extending perpendicularly from the first limb, the second limb extending perpendicularly to the tie bar.

6. The connector according to claim 5, wherein at least one of the first and second limbs includes a detent element projecting into the slit, the detent element being configured to resiliently displace and engage in a counter-detent element of a counter-contact section of the mating connector.

7. A method of producing a multipole electrical connector, the method comprising:

producing a contact set from a single metal strip, the contact set including a plurality of contact elements, each of the contact elements including a contact section and a connecting section, each of the contact elements configured to receive a different counter-contact section of a multipole mating connector, the contact elements being arranged in a single plane and forming a single-layer stamped grid; and supporting the contact set within a housing, wherein the counter-contact section forms a non-zero angle with the single-layer stamped grid.

8. The method according to claim 7, further comprising:

partially extrusion coating at least each connecting section of each contact element to form the housing.

9. The method according to claim 7, further comprising:

clamping each contact element between two halves of the housing.

10. The method according to claim 7, wherein the step of producing the contact set includes stamping the contact set from the single metal strip.

11. The method according to claim 7, wherein the step of producing the contact set includes producing at least one crossbar between the plurality of contact elements.

12. The method according to claim 11, further comprising:

removing the at least one crossbar.

13. The method according to claim 7, wherein each contact section is forked shaped and includes a first limb and a second limb, the second limb being separated by a slit from the first limb and being disposed at least over a partial length of the first limb.

14. The method according to claim 13, wherein the first limb and the second limb are disposed parallel to each other.

15. The method according to claim 13, wherein at least one of the first and second limbs includes a detent element projecting into the slit, the detent element being configured to resiliently displace and engage in a counter-detent element of a counter-contact section of the mating connector.

16. A multipole electrical connector for providing a releasable coupling with a multipole mating connector, comprising:

a housing; and a contact set supported in the housing, the contact set including a plurality of contact elements, each of the contact elements including a contact section and a connecting section, a first one of the contact elements being configured to receive a first counter-contact section of the multipole mating connector, and a second one of the contact elements being configured to receive a second counter contact section of the multipole mating connector, the second counter contact section being oriented in a different direction than the first counter contact section; wherein the contact elements are arranged in a single plane and form a single-layer stamped grid.

17. The connector according to claim 16, wherein the first counter contact section and the second counter contact section are oriented perpendicularly relative to one another.

18. A method of producing a multipole electrical connector, the method comprising:

producing a contact set from a single metal strip, the contact set including a plurality of contact elements, each of the contact elements including a contact section and a connecting section, each of the contact elements configured to receive a different counter-contact section of a multipole mating connector, a first one of the contact elements being configured to receive a first counter-contact section of a multipole mating connector, and a second one of the contact elements being configured to receive a second counter contact section of the multipole mating connector, the second counter contact section being oriented in a different direction than the first counter contact section, the contact elements being arranged in a single plane and forming a single-layer stamped grid; and supporting the contact set within a housing.

19. The method according to claim connector according to claim 18, wherein the first counter contact section and the second counter contact section are oriented perpendicularly relative to one another.

* * * * *